US007134680B2

(12) United States Patent
Emig et al.

(10) Patent No.: US 7,134,680 B2
(45) Date of Patent: Nov. 14, 2006

(54) ALPINE SKI

(75) Inventors: Uwe Emig, Waldbrunn (DE); Reinhold Geilsdörfer, Mosbach (DE); Markus Gramlich, Waldbrunn (DE)

(73) Assignee: Innotec Gesellschaft zur Entwicklung Innovativer Technologien Uwe Emig, Prof. Reinhold Geilsdorfer, Markus Gramlich GBR, Mosbach (DE)

( * ) Notice: Subject to any disclaimer, the term of this patent is extended or adjusted under 35 U.S.C. 154(b) by 60 days.

(21) Appl. No.: 10/501,921

(22) PCT Filed: Jan. 29, 2003

(86) PCT No.: PCT/DE03/00238

§ 371 (c)(1),
(2), (4) Date: Jul. 27, 2004

(87) PCT Pub. No.: WO03/063973

PCT Pub. Date: Aug. 7, 2003

(65) Prior Publication Data

US 2005/0104328 A1 May 19, 2005

(30) Foreign Application Priority Data

Feb. 1, 2002 (DE) ..... 102 04 330

(51) Int. Cl.
*A63C 5/07* (2006.01)

(52) U.S. Cl. ..... 280/602; 280/607

(58) Field of Classification Search ..... 280/602, 280/607, 609, 610, 601, 634, 636
See application file for complete search history.

(56) References Cited

U.S. PATENT DOCUMENTS

| | | | | |
|---|---|---|---|---|
| 5,326,126 | A * | 7/1994 | Ruffinengo | 280/602 |
| 5,393,086 | A * | 2/1995 | Le Masson et al. | 280/602 |
| 6,182,998 | B1 * | 2/2001 | Huyghe et al. | 280/602 |
| 6,193,262 | B1 * | 2/2001 | Silva | 280/607 |
| 6,270,108 | B1 * | 8/2001 | Phelipon et al. | 280/602 |
| 6,679,513 | B1 * | 1/2004 | Emig et al. | 280/602 |
| 6,883,823 | B1 * | 4/2005 | Riepler et al. | 280/602 |
| 6,886,848 | B1 * | 5/2005 | Riepler | 280/602 |
| 2004/0046362 | A1 * | 3/2004 | Restani | 280/602 |
| 2004/0100067 | A1 * | 5/2004 | Riepler et al. | 280/602 |
| 2005/0104328 | A1 * | 5/2005 | Emig et al. | 280/602 |
| 2005/0206128 | A1 * | 9/2005 | Gignoux | 280/602 |

FOREIGN PATENT DOCUMENTS

| | | |
|---|---|---|
| DE | 36 19 118 A 1 | 12/1997 |
| DE | 199 17 992 A 1 | 11/2000 |
| FR | 1304880 | 9/1962 |

* cited by examiner

*Primary Examiner*—J. Allen Shriver

(74) *Attorney, Agent, or Firm*—Arent Fox PLLC

(57) ABSTRACT

In an alpine ski with an elongate ski body (1) forming a running surface (5), a mounting (7) for fastening a binding arranged on the upper face of the ski body (1) and rigidly connected therewith and attached to the ski body (1), extending in the longitudinal direction of the ski body (1) and receiving pressure forces, at least one upper cord element (11), the ends thereof being supported on the ski body (1), the upper cord element (11) being movably mounted relative to the ski body (1) between its ends and constructed such that under the impact of pressure forces it endeavours to deform elastically by flexural buckling and to carry out a deflection movement relative to the ski body (1). Support elements (17) are provided on the ski body (1) which counteract the deflection movement of the upper cord element (11) by exerting a counterforce.

19 Claims, 2 Drawing Sheets

ALPINE SKI

CROSS-REFERENCE TO RELATED APPLICATION

Figure 1:
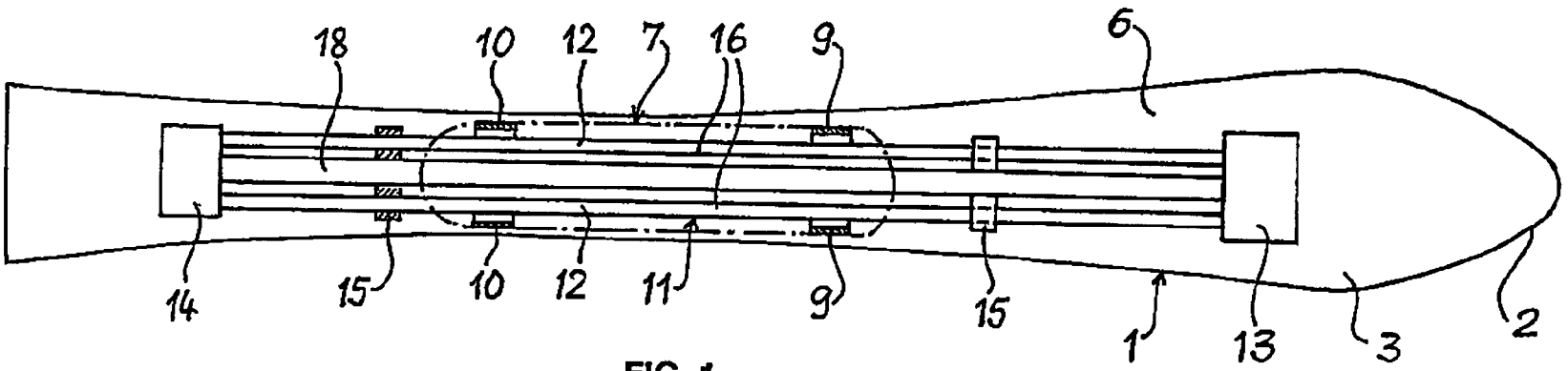

This application is a National Stage entry of International Application No. PCT/DE03/00238, filed Jan. 29, 2003. The disclosure of the prior application is hereby incorporated herein in its entirety by reference.

The invention relates to an alpine ski with an elongate ski body forming a running surface, a mounting for fastening a binding arranged on the upper face of the ski body and, attached to the ski body, extending in the longitudinal direction of the ski body and receiving pressure forces, at least one upper cord element, the ends thereof being supported on the ski body.

In an alpine ski known from DE 199 17 992 of the aforementioned type, the upper cord element built into the ski body has the form of a flat upwardly curved arc in the middle region of the ski which extends in the longitudinal direction of the ski and spans a lower cord element located therebelow and arranged in the ski body. The arc of the upper cord element can be deflected in the direction of the lower cord element as a function of the load emanating from the binding and the upper cord element is supported on the end region of the ski such that a displacement of the ends of the upper cord element resulting from the deflection of the arc produces an increase in the load bearing portion of the end regions of the ski.

The object of the invention is to improve further the running properties of an alpine ski of the aforementioned type and to allow a surface pressure distribution adapting to the loads of the ski.

This object is achieved by the invention stated in claim 1. Advantageous embodiments of the invention are stated in the dependent claims.

In the alpine ski according to the invention the mounting for fastening the binding is rigidly connected to the ski body forming the running surface. The skier can therefore precisely control and regulate the movements of the ski and reliably react to piste conditions, whereby a high level of safety is achieved. The alpine ski according to the invention furthermore has the advantage that its bending resistance and therefore the surface pressure distribution can be changed as a function of the load, whereby an improved edge grip and greater control stability can be achieved, especially at higher speeds. Furthermore, the alpine ski according to the invention distinguished by a favourable surface pressure distribution, as the loads are not only transmitted into the region of the mounting for the binding but also onto the support positions of the upper cord element on the ski body. The ski body itself can be less rigidly designed, whereby an improved adaptation to uneven pistes can be achieved. The variable bending resistance and the means damping the deformation movement of the upper cord element furthermore contribute to the exceptionally smooth running of the ski according to the invention, even on very uneven piste surfaces.

A further important advantage of the alpine ski according to the invention is that by altering the support length and the bending resistance of the upper cord element the running properties of the ski can be affected to a considerable extent, so that the ski is easily adapted to the different requirements of the skier. The alpine ski according to the invention thus opens up the possibility of manufacturing a design of ski adapted to the individual needs of a skier by the provision of a number of prefabricated components and by a selected combination of these components.

According to a further proposal of the invention the upper cord element comprises at least one slightly curved rod which spans the ski body in the manner of an arc. The upper cord element is preferably formed from a plurality of slightly curved rods which are arranged adjacent to one another spanning the ski body. The length of the rods can be uniform or different and larger or smaller than half the length of the ski body. The rods can be designed to be hollow or solid and manufactured from light metal or a fibrous composite material. Furthermore the rods can have a cross-section which is uniform or tapering toward the ends of the rod. The rods can moreover be designed in one piece or several pieces. The rods can be arranged relative to the ski body in such a manner that the planes defined by their curved longitudinal axes are either arranged perpendicular to the running surface of the ski body or inclined toward the running surface of the ski body. In the latter case it is advantageous if a spacing remains between the rods arranged on both sides of the middle of the ski body, into which spacing the middle portions of the rods can move under the effect of pressure forces and the rods are arranged in such a manner that the planes defined by their curved longitudinal axes abut one another above the ski. In such an arrangement the curved path of the rods substantially corresponds to the waisting of the ski body and thereby allows an advantageous design of ski.

According to a further proposal of the invention the mounting for fastening the binding can be connected to the ski body in such a manner that the elastic deformability of the ski body is not thereby affected. For this purpose it can be provided that the mounting comprises at least two supports arranged at a distance from one another in the longitudinal direction, one support being rigidly connected to and the other support longitudinally movable with the ski body. If on the other hand the ski body comprises two supports for fastening the mounting for the binding arranged longitudinally at a distance from one another, according to the invention the mounting is rigidly attached to one support and longitudinally displacable on the other support.

According to a further proposal of the invention the mounting for fastening the binding comprises a plate which extends over the upper cord element. The plate preferably carries a support element on its lower face for supporting the upper cord element. The support element can according to the invention comprise a spring compressible by the upper cord element and which, by exerting a counter force, counteracts a movement of the upper cord element directed against the support element. In a further embodiment the support element can comprise a bearing with a sliding surface on which the upper cord element can slide transversely to its longitudinal direction.

According to a further proposal of the invention, to be able to adjust the deformation resistance of the alpine ski according to the invention and its deformation behaviour easily, the support of at least one end of the upper cord element or of the rods forming it is designed to be adjustable in the longitudinal direction of the ski body. If the upper cord element comprises rods, then the longitudinal adjustability can be easily carried out by an adjusting screw rotatably attached to one rod end, and which is screwed into a tapped hole of an abutment fastened to the ski body. If multipart rods are provided, then to achieve the longitudinal adjustability the rod ends facing one another can be connected to one another by means of a tensioning device with adjustable nuts.

According to a further proposal of the invention to reduce the buckling stress of the rods, guides can be provided at a distance from the rod ends fastened to the ski body and in which the rods are longitudinally displaceably guided. The guides can moreover be formed in such a manner that they allow a limited transverse movement of the rods in particular in the direction of the planes defined by their curved longitudinal axes. Furthermore, according to the invention damping elements acting on the rods can be provided which dampen the deformation movements of the rods occurring under compressive stress. The damping elements can for example be arranged in guide holes penetrated by the rods and comprise bushes or rings made of elastomeric material, for example rubber.

According to a further proposal of the invention a traction element can moreover be arranged on the upper face of the ski body which extends in the longitudinal direction of the ski body and the ends thereof are fastened to the end regions of the ski body, the ski body comprising a support protruding from the ski body in at least one position between the ends of the traction element and on which support the tensioned traction element rests. The object of the traction element is to reduce the deflection of flexural vibrations of the ends of the ski body directed against the running surface, so that as a result the alpine ski runs more smoothly. The height of the support protruding from the ski body can be adjustable, to be able to adjust the tension of the traction element. It is also possible to design the fastening of one end of the traction element to be longitudinally adjustable.

Figure 2:
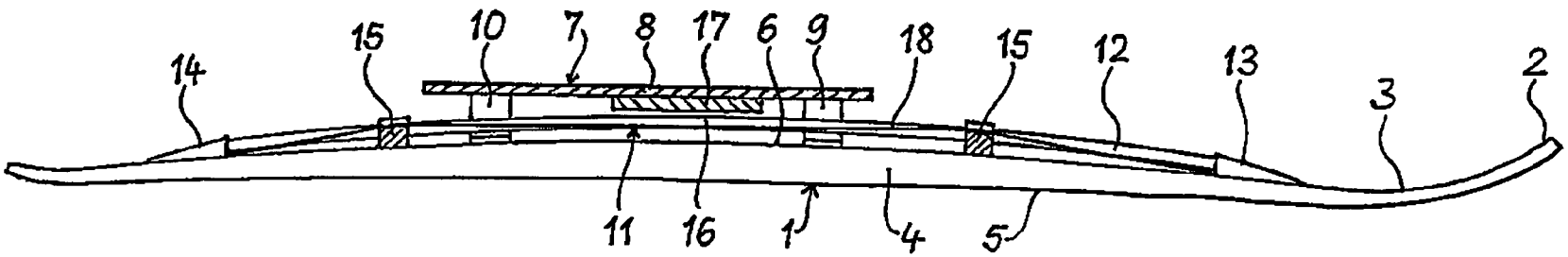
Figure 3:
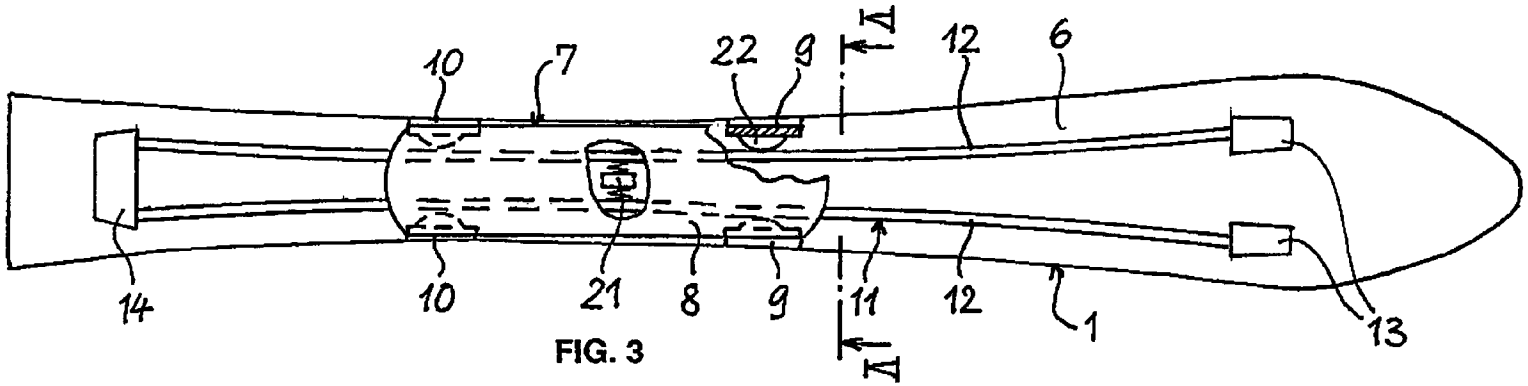
Figure 4:
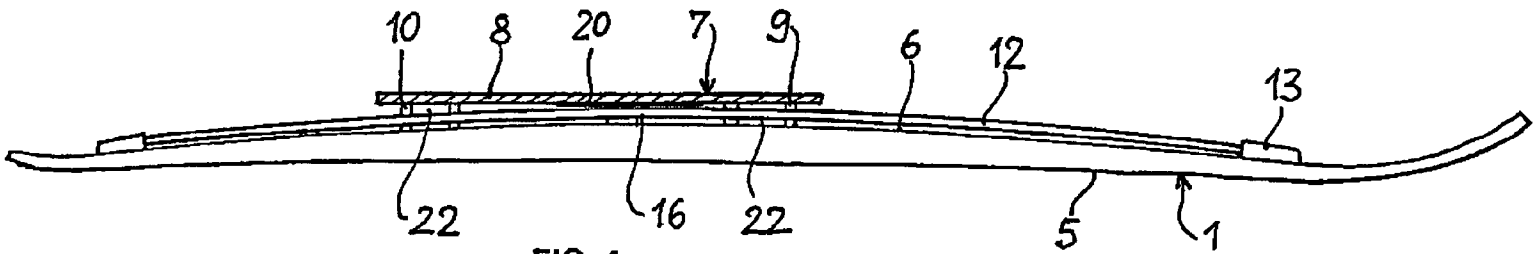
Figure 5:
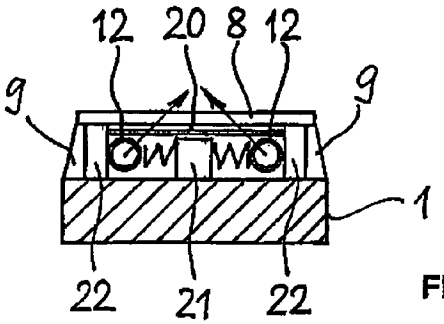

The invention will hereinafter be described in more detail with reference to embodiments which are shown in the drawings, in which:

FIG. 1 is a plan view of an embodiment of an alpine ski with an upper cord element formed by two rods arranged parallel and adjacent to one another, FIG. 2 is a side view of the alpine ski according to FIG. 1, FIG. 3 is a plan view of a second embodiment of an alpine ski with an upper cord element formed from two rods bent toward one another, FIG. 4 is a side view of the alpine ski according to FIG. 3 and FIG. 5 is a cross section through the alpine ski according to FIG. 3 along the line V—V.

The alpine ski shown in FIGS. 1 and 2 comprises a ski body 1, the design thereof substantially resembling conventional ski designs. The ski body 1 has at its front end an upwardly curved shovel 3 tapering toward the ski tip 2 and has a rectangular cross-section, the height thereof increasing from the ends of the ski body toward the middle and the width thereof decreasing from the ends toward the middle, whereby concave curved side faces 4 are formed. The lower face of the ski body 1 forms a running surface 5, the side edges thereof being strengthened by metallic layers in the usual manner. The ski body 1 can be manufactured from wood, plastics material, fibrous composite material and metal and in sandwich construction from a plurality of these materials.

In the middle region on the longitudinally, slightly convex, curved upper face 6 of the ski body 1 a mounting 7 is attached for fastening a binding for the boot of the skier. The mounting 7 comprises a flat plate 8 arranged at a distance from the upper face 6, which on its front and trailing ends respectively carries two downwardly turned supports 9, 10, the free ends thereof being fastened to the ski body 1. The fastening of the support 9 is formed in such a manner that its ends are held fixed to the ski body 1. The connection can thus be made rigidly or rotatably about an axis extending in a transverse direction. The ends of the supports 10 are fastened to the ski body 1 in such a manner that a limited relative movement between the supports 10 and the ski body 1 is possible in the longitudinal direction thereof but not possible in any other direction. The disclosed fastening of the mounting 7 on the ski body 1 ensures that under load elastic deformations of the ski body 1 are not hampered by the mounting 7. The ski body 1 can thus better adapt itself to the respective curvature of the piste surface. A favourable distribution of the load emanating from the mounting 7 on the ski body 1 is achieved by means of the spacing of the supports 9, 10.

On the upper face 6 of the ski body 1 beneath the plate 8 and between the supports 9, 10 an upper cord element 11 is located which comprises two parallel rods 12 designed to receive pressure forces. The rods 12 have an upwardly curved curvature and are arranged symmetrically to the middle plane of the ski body 1. Their curved middle axes are located in planes substantially perpendicular to the running surface 5. The rods 12 comprise tubes made of light metal and have a uniformly circular cross-section. The ends of the rods 12 are supported on abutments 13, 14, which are fastened at a distance from the ends of the ski body 1 on the upper face 6 thereof. The abutments 13, 14 comprise flat blocks which have holes on one face into which the rods 12 are inserted. Between the abutments 13, 14 and the supports 9, 10 guide elements 15 are moreover fastened to the ski body 1. The guide elements 15 respectively have two parallel holes through which the rods 12 are inserted.

The diameter of these holes is greater than the external diameter of the rods 12 so that the rods 12 can carry out limited transverse movements within the holes. The guide elements 15 serve to limit the flexural buckling of the rods 12 when the ski is weighted and to prevent lateral buckling of the rods 12. Bushes or rings made from elastomeric material inserted into the holes of the guide elements 15 can moreover contribute to the damping of vibrations.

The apex region 16 of the curved rods 12 is located under the plate 8 at a distance therefrom, so that under the impact of pressure forces acting on the abutments 13, 14 on the rods 12 it can deflect upwards by flexural buckling of the rods 12. A support element 17 which is attached to the lower face of the plate 8 acts against the deflection of the apex regions 16. The support element 17 is made of an elastically compressible material, for example rubber or foam rubber, and with increasing deformation by the rods 12 exerts an increasing counter force to a predetermined level which increasingly inhibits the deflection of the apex regions 16 of the rods 12 and finally restricts it to a maximum limit. During this process, which is caused by greater weighting of the end regions of the alpine ski, the bending resistance of the alpine ski increases and thus the relative load bearing portion of its end region. This leads to an improved ability to control the ski and as a result of shorter deformation paths it runs more smoothly. The deformation behaviour of the alpine ski can additionally be varied by altering the deformation resistance of the support element 17 and adapted to the requirements of the skier. To vary its deformation resistance the support element 17 can be exchanged for a more flexible or more rigid support element. Further variations are possible by altering the length of the rods 12 and their initial curvature.

To limit the deformation of the alpine ski when unweighted a traction element 18 in the form of a fabric tape resistant to tensile stress is provided on the upper face 6 between the rods 12. The traction element 18 rests on the guide elements 15 and is held thereby at a distance from the upper face 6 of the ski body 1. The ends of the traction element 18 are fastened to the abutments 13, 14. When the alpine ski is unweighted the traction element 18 is slightly tensioned. When the alpine ski is weighted, the traction element then loses its tension but can if necessary be held slightly under tension by a flexible tensioning element supported on the plate 8 in the manner of a belt tensioner.

The traction element 18 has the following effect when skiing. If the ski tip is unweighted when skiing into a hollow, the tensioning traction element 18 reduces the unweighting movement of the ski tip. By supporting the traction element 18 on the abutment 14 the tensile force impacting on the trailing end of the ski body is thereby increased, whereby a slight raising of the ski end is brought about. If the trailing end of the alpine ski is in a hollow, the effect on the ski tip and ski end is reversed. Generally the vertical vibrations of the ends of the alpine ski are noticeably reduced by this behaviour and the ski runs more quietly and is more directionally stable, especially on uneven ski pistes. The friction of the traction element 18 on the guide elements 15 also has a vibration damping effect.

The embodiment shown in FIGS. 3 to 5 differs from the aforementioned embodiment in the following disclosed features. The curved rods 12 forming the upper cord element 11 are fastened to the abutments 13, 14 in such a manner that the planes in which the curved middle axes of the rods 12 are located, extend approximately at an angle of 45° to the running surface 5 of the ski body 1 and such that the planes abut above the ski body 1. This arrangement of rods 12 has the advantage that their adjacent ends can be at a greater distance from one another so that the pressure forces to be received by the rods are effective nearer to the edges of the ski body 1 and therefore contribute more effectively to the reduction of torsional stress of the ski.

Depending on the inclined position of the planes of their curved middle axes, in this embodiment the apex regions 16 of the rods 12 endeavour to carry out a deflection movement in the direction of the arrows shown in FIG. 5. This deflection movement is thus deflected toward the middle of the ski. A bearing element 20 is additionally provided on the lower face of the plate 8 of the mounting 7 with a flat sliding surface on which the apex regions 16 of the rods 12 rest. If the rods 12 are loaded by pressure forces their apex regions 16 are then prevented by the bearing element 20 from moving in the direction of the arrows but forced to slide along the bearing element 20 in the direction of the middle of the ski. Between the two apex regions 16 a sprung support element 21 is arranged which is fastened to the ski body 1 and produces a spring force counteracting the compensating movement of the apex regions 16. By altering the initial spring force and spring characteristics of the support element 21 the bending resistance of the ski and its running properties can be altered.

In the embodiment according to FIGS. 3 to 5 the function of the rods 12 is also to affect the bending behaviour of the ski when unweighted. The rods 12 are fastened in the abutments 13, 14 in such a manner that tensile forces can also be transmitted. Furthermore, between the rods 12 and the supports 9, 10 of the mounting 7 resilient support elements 22 are provided on which the rods 12 rest. If the ski body 1 is suddenly unweighted at one end during skiing, the movement of the ski end thereby initiated produces a tensile force on the ends of the rods 12 in the direction of the running surface. Under the effect of this tensile force the rods 12 endeavour to reduce their curvature by deflecting in the direction of the supports 9, 10, more or less rigidly pressing together the resilient support elements 22 according to the degree of tensile force. By altering the resilience of the support elements 22 this compensating process and therefore the bending and vibration behaviour of the ski can also be affected.

In addition to the disclosed embodiments numerous further embodiments of the alpine ski according to the invention are possible. Thus for example the number of rods forming the upper cord element can be greater, both an even and an odd number of rods being possible. In addition to the disclosed symmetrical arrangement of the rods, to achieve specific running properties an asymmetrical arrangement can be provided, in which for example rods of differing lengths or differing rigidity are arranged adjacent to one another on a ski body. The resilience of the support elements working in cooperation with the rods can also be different for each rod, to achieve asymmetrical deformation behaviour of the alpine ski. The alpine ski according to the invention further offers the possibility of designing the components affecting the bending behaviour to be easily exchangable or adjustable relative to their effects parameters, to allow the skier the opportunity of adapting in situ the running properties of the ski to the respective piste conditions. Furthermore, the ski according to the invention can be manufactured in the manner of a modular system, the features desired by a purchaser being able to be obtained by assembling the ski from separate parts designed therefor and individually tailored to fit.

The invention claimed is:

1. Alpine ski comprising an elongate ski body forming a running surface, a mounting for fastening a binding arranged on an upper face of the ski body and rigidly connected therewith, at least one upper cord element attached to the ski body extending in the longitudinal direction of the ski body and receiving pressure forces, the at least one upper cord element having ends thereof supported on the ski body, the at least one upper cord element being movably mounted relative to the ski body between ends of the ski body and constructed such that under the impact of pressure forces the at least one upper cord element endeavours to deform elastically by flexural buckling and to carry out a deflection movement relative to the ski body, and at least one support element provided on the mounting which counteracts the deflection movement of the at least one upper cord element by exerting a counter force thereon, the at least one support element being spaced from the at least one upper cord element along an entire length thereof in a direction parallel to the longitudinal direction of the ski body.

2. Alpine ski according to claim 1, characterised in that the at least one upper cord element comprises at least one slightly curved rod which spans the ski body in the manner of an arc.

3. Alpine ski according to claim 1, characterised in that the at least one upper cord element is formed from a plurality of slightly curved rods which are arranged adjacent to one another spanning the ski body.

4. Alpine ski according to claim 2 or claim 3, characterised in that the rod is arranged relative to the ski body in such a manner that the plane defined by its curved longitudinal axis is oriented perpendicular to the running surface of the ski body.

5. Alpine ski according to claim 2 or claim 3, characterised in that the rod is arranged relative to the ski body in such a manner that the plane defined by its curved longitudinal axis is inclined toward the running surface of the ski body.

6. Alpine ski according to claim 5, characterised in that at least two rods are arranged in such a manner that the planes defined by their curved longitudinal axes abut one another above the ski.

7. Alpine ski according to claim 1, characterised in that the mounting for fastening the binding is connected to the ski body such that the elastic deformability of the ski body is not affected.

8. Alpine ski according to claim 1, characterised in that the mounting comprises at least two supports arranged longitudinally at a distance from one another, one support being rigidly connected and the other support longitudinally displacably connected to the ski body.

9. Alpine ski according to claim 1, characterised in that the support of at least one end of the at least one upper cord element or of a rod forming it is adjustable in the longitudinal direction of the ski body.

10. Alpine ski according to claim 2 or claim 3, characterised in that at a distance from the ends of the rod fastened to the ski body at least one guide element is provided, in which the rod is longitudinally displacably guided.

11. Alpine ski according to claim 1, characterised in that damping elements acting on the at least one upper cord element are provided which dampen the compensating movements of the at least one upper cord element occurring under compressive stress.

12. Alpine ski according to claim 1, characterised in that the ends of the at least one upper cord element are connected to the ski body by a connection transmitting pressure forces and tensile forces and that the at least one upper cord element is constructed and/or mounted such that under the impact of tensile forces the at least one upper cord element endeavours to deform elastically.

13. Alpine ski comprising an elongate ski body forming a running surface, a mounting for fastening a binding arranged on an upper face of the ski body and rigidly connected therewith, at least one upper cord element formed from a plurality of slightly curved rods which are arranged adjacent to one another spanning the ski body, the at least one upper cord element attached to the ski body extending in the longitudinal direction of the ski body and receiving pressure forces, the at least one upper cord element having ends thereof supported on the ski body, the at least one upper cord element being movably mounted relative to the ski body between ends of the ski body and constructed such that under the impact of pressure forces the at least one upper cord element endeavours to deform elastically by flexural buckling and to carry out a deflection movement relative to the ski body, and at least one support element provided on the mounting which counteracts the deflection movement of the at least one upper cord element by exerting a counter force thereon, wherein between the rods arranged on both sides of the middle of the ski body a spacing is provided into which the apex regions of the rods can move under the effect of pressure forces.

14. Alpine ski comprising an elongate ski body forming a running surface, a mounting for fastening a binding arranged on an upper face of the ski body and rigidly connected therewith, at least one upper cord element attached to the ski body extending in the longitudinal direction of the ski body and receiving pressure forces, the at least one upper cord element having ends thereof supported on the ski body, the at least one upper cord element being movably mounted relative to the ski body between ends of the ski body and constructed such that under the impact of pressure forces the at least one upper cord element endeavours to deform elastically by flexural buckling and to carry out a deflection movement relative to the ski body, and at least one support element provided on the mounting which counteracts the deflection movement of the at least one upper cord element by exerting a counter force thereon, wherein the mounting for fastening the binding comprises a plate having a lower face and extending over the at least one upper cord element and carries the at least one support element on the lower face for supporting the at least one upper cord element.

15. Alpine ski according to claim 14, characterised in that the at least one support element comprises a spring compressible by the at least one upper cord element.

16. Alpine ski according to claim 14, characterised in that the at least one support element comprises a bearing element with a sliding surface on which the at least one upper cord element slides transversely to its longitudinal direction.

17. Alpine ski comprising an elongate ski body forming a running surface, a mounting for fastening a binding arranged on an upper face of the ski body and rigidly connected therewith, at least one upper cord element attached to the ski body extending in the longitudinal direction of the ski body and receiving pressure forces, the at least one upper cord element having ends thereof supported on the ski body, the at least one upper cord element being movably mounted relative to the ski body between ends of the ski body and constructed such that under the impact of pressure forces the at least one upper cord element endeavours to deform elastically by flexural buckling and to carry out a deflection movement relative to the ski body, the at least one upper cord element comprising at least one slightly curved rod which spans the ski body in the manner of an arc, and at least one support element provided on the mounting which counteracts the deflection movement of the at least one upper cord element by exerting a counter force thereon, wherein at a distance from the ends of the rod fastened to the ski body at least one guide element is provided, in which the rod is longitudinally displacably guided, the guide element being formed in such a manner that it allows a limited transverse movement of the rod in the direction of the plane defined by its curved longitudinal axis.

18. Alpine ski comprising an elongate ski body forming a running surface, a mounting for fastening a binding arranged on an upper face of the ski body and rigidly connected therewith, at least one upper cord element attached to the ski body extending in the longitudinal direction of the ski body and receiving pressure forces, the at least one upper cord element having ends thereof supported on the ski body, the at least one upper cord element being movably mounted relative to the ski body between ends of the ski body and constructed such that under the impact of pressure forces the at least one upper cord element endeavours to deform elastically by flexural buckling and to carry out a deflection movement relative to the ski body, and at least one support element provided on the mounting which counteracts the deflection movement of the at least one upper cord element by exerting a counter force thereon, wherein on an upper face of the ski body a traction element is arranged which extends in the longitudinal direction of the ski body and having ends fastened to end regions of the ski body, the ski body comprising a support protruding from the ski body in at least one position between the ends of the traction element, on which support the tensioned traction element rests.

19. Alpine ski comprising an elongate ski body forming a running surface, a mounting for fastening a binding arranged on an upper face of the ski body and rigidly connected therewith, at least one upper cord element attached to the ski body extending in the longitudinal direction of the ski body and receiving pressure forces, the at least one upper cord element having ends thereof supported on the ski body, the at least, one upper cord element being movably mounted relative to the ski body between ends of the ski body and constructed such that under the impact of pressure forces the at least one upper cord element endeavours to deform elastically by flexural buckling and to carry out a deflection movement relative to the ski body, the at least one upper cord element being formed from a plurality of slightly curved rods which are arranged adjacent to one another spanning the ski body, and at least one support element provided on the mounting which counteracts the deflection movement of the at least one upper cord element by exerting a counter force thereon, wherein at a distance from the ends of the rod fastened to the ski body at least one guide element is provided, in which the rod is longitudinally displacably guided, the guide element being formed in such a manner that it allows a limited transverse movement of the rod in the direction of the plane defined by its curved longitudinal axis.

* * * * *